United States Patent [19]

Byléhn et al.

[11] Patent Number: 4,708,829

[45] Date of Patent: Nov. 24, 1987

[54] APPARATUS FOR THE REMOVAL OF IMPURITIES FROM FIBER SUSPENSIONS

[75] Inventors: Bo V. S. Byléhn, Sundsvall; Iage H. Granqvist, Alnö , both of Sweden

[73] Assignee: Sunds Defibrator Aktiebolag, Sweden

[21] Appl. No.: 740,063

[22] PCT Filed: Sep. 21, 1984

[86] PCT No.: PCT/SE84/00305

§ 371 Date: May 28, 1985

§ 102(e) Date: May 28, 1985

[87] PCT Pub. No.: WO85/01888

PCT Pub. Date: May 9, 1985

[30] Foreign Application Priority Data

Oct. 27, 1983 [SE] Sweden ..... 8305912

[51] Int. Cl.[4] ..... B01F 3/04

[52] U.S. Cl. ..... 261/62; 162/65; 209/170; 210/221.2; 239/434; 261/64.1; 261/76

[58] Field of Search ..... 261/76, 63, 64 R, 62, 261/DIG. 75, DIG. 54; 209/170; 210/221.2; 417/174; 162/63, 65; 239/428.5, 434; 366/101

[56] References Cited

U.S. PATENT DOCUMENTS

| | | | |
|---|---|---|---|
| 2,300,642 | 11/1942 | Booth | 261/76 X |
| 2,905,543 | 9/1959 | Schreter et al. | 261/76 X |
| 3,256,802 | 6/1966 | Karr | 261/DIG. 75 |
| 3,397,871 | 8/1968 | Hasselberg | 261/DIG. 75 |
| 3,489,396 | 1/1970 | D'Aragon | 261/76 X |
| 3,722,679 | 3/1973 | Logue | 209/170 X |
| 4,014,961 | 3/1977 | Popov | 261/76 |
| 4,186,094 | 1/1980 | Hellberg | 261/DIG. 75 |
| 4,347,128 | 8/1982 | Barnscheidt | 209/170 |
| 4,412,568 | 11/1983 | Hughes | 261/DIG. 75 |
| 4,479,908 | 10/1984 | Arbeille et al. | 261/DIG. 75 |

FOREIGN PATENT DOCUMENTS

| | | | |
|---|---|---|---|
| 1782158 | 11/1971 | Fed. Rep. of Germany . | |
| 2415940 | 4/1980 | Fed. Rep. of Germany . | |
| 130213 | 10/1981 | Japan . | |
| 9742 | 10/1923 | Netherlands | 261/76 |
| 7704203 | 1/1983 | Sweden . | |
| 382542 | 10/1932 | United Kingdom | 261/76 |
| 694918 | 7/1953 | United Kingdom | 261/DIG. 75 |
| 1329121 | 9/1973 | United Kingdom . | |

*Primary Examiner*—Richard L. Chiesa

*Attorney, Agent, or Firm*—Lerner, David, Littenberg, Krumholtz & Mentlik

[57] ABSTRACT

Apparatus for the mixing of gas bubbles into fiber suspensions in order to remove impurities from the fiber suspension by means of flotation is disclosed, including an inlet, an outlet including diverging upper and lower walls, an intermediate mixing section including upper and lower wall surfaces and a wing suspended between them in order to create upper and lower passages in the intermediate mixing section, the wing including an initial diverging portion, a central portion and a subsequent converging portion so that the central portion has a maximum thickness corresponding to the minimum transverse dimension for the upper and lower passages, the converging portion of the wing corresponding with the diverging upper and lower wall portions of the outlet so that the upper and lower passages diverge substantially symmetrically in the direction of flow, and an aperture for injecting a gas such as air at a location corresponding to the central portion of the wing.

10 Claims, 2 Drawing Figures

APPARATUS FOR THE REMOVAL OF IMPURITIES FROM FIBER SUSPENSIONS

FIELD OF THE INVENTION

The present invention relates to devices for removing impurities from fiber suspensions, and in particular for removing impurities in the form of solid particles from fiber suspensions by means of flotation. More particularly, the present invention relates to such apparatus for effecting flotation in which gas bubbles are mixed with and distributed in the fiber suspension. Still more particularly, the present invention relates to such devices in which the gas bubbles adhere to the impurities and rise to the surface so as to form a foam mixed with the impurities, and in which the foam can then be removed from the suspension.

BACKGROUND OF THE INVENTION

Flotation processes of this type, in which solid impurities are removed by flotation, are known. These include those processes which are used for removing printer's ink from the paper pulp produced from newspaper waste. In these processed air is injected into a suspension of the paper pulp, which is then passed into the lower part of a flotation container. The air can be admixed therewith in a separate mixing chamber, such as that of the type disclosed in SE-PS No. 7704203-4. Prior to being fed into the flotation container, the suspension is passed through the mixing chamber in the form of a thin layer, and at the same time the air is injected into this layer in a transverse direction. It has been found to be difficult, however, to obtain a uniform distribution of the bubbles, especially in connection with high flow rates of the suspension. This applies, for example, in those cases where the suspension is to be fed tangentially into a cylindrical flotation container at a sufficiently high rate so that the suspension is caused to rotate within the container. The purpose of obtaining such rotation of the suspension is to facilitate removal of a foam which is rich in impurities from the surface of the suspension in the container.

It is therefore an object of the present invention to provide a new design for the mixing chambers in such processes so that these aforesaid disadvantages can now be eliminated.

SUMMARY OF THE INVENTION

In accordance with the present invention, these and other objects have now been accomplished by applicants' discovery of apparatus for mixing gas bubbles into a fiber suspension containing impurities so as to remove those impurities by means of flotation, in which the apparatus includes an inlet for the fiber suspension, an outlet for the fiber suspension now including the gas bubbles, the outlet including diverging upper and lower wall portions, an intermediate mixing section between the inlet and the outlet, the intermediate mixing section including an upper wall surface, a lower wall surface, and a wing member suspended between the upper and lower wall surfaces, thereby creating upper and lower passages between the wing member and these upper and lower wall surfaces, the wing member including a divering portion facing the inlet, a converging portion facing the outlet, and a central portion having a maximum thickness therebetween, so that the upper and lower passages have a minimum transverse dimension at a location corresponding to the central portion of the wing member, the converging portion of the wing member also corresponding with the diverging upper and lower wall portions of the outlet, whereby the upper and lower passages diverge substantially symmetrically in a direction of flow of the fiber suspension containing the gas bubbles, gas injection means including a transversely extending slot in both the upper and lower wall surfaces of the intermediate mixing section at locations corresponding to the central portion of the wing member, and gas supply means communicating with the gas injection means for supplying the gas to the fiber suspension flowing through the upper and lower passages.

In accordance with a preferred embodiment of the apparatus of the present invention, the inlet has an elongated rectangular cross-sectional configuration.

In accordance with another embodiment of the apparatus of the present invention, the wing member is centrally located between the upper and lower wall portions of the intermediate mixing sections, and in a preferred embodiment, the gas injection means comprises adjustable gas injection means for adjusting the dimensions of the transversely extending slot.

In accordance with another embodiment of the apparatus of the present invention, the diverging upper and lower wall surfaces of the outlet diverge at a first predetermined angle, and the converging portion of the wing member converges at a second predetermined angle, and most preferably these first and second predetermined angles are substantailly the same. In a preferred embodiment, these angles are between about five and ten degrees.

In accordance with another embodiment of the apparatus of the present invention, minimum transverse dimensions of the upper and lower passages are between about 4 and 16 mm. In a preferred embodiment, the minimum transverse dimensions are between about 6 and 10 mm.

In accordance with another embodiment of the apparatus of the present invention, the ratio of the cross-sectional area of the intermediate mixing section at a location corresponding to the central portion of the wing member to the area of the outlet is between about 1:4 and about 1:6.

In accordance with another embodiment of the apparatus of the present invention, the transversely extending slots in the upper and lower wall surfaces of the intermediate mixing section are directed obliquely towards the direction of flow of the fiber suspension from the inlet to the outlet.

BRIEF DESCRIPTION OF THE DRAWINGS

The present invention can be more fully understood in connection with the following detailed description, and with reference to the accompanying drawings, which illustrate one embodiment of the present invention, and in which.

DETAILED DESCRIPTION

Figure 1:
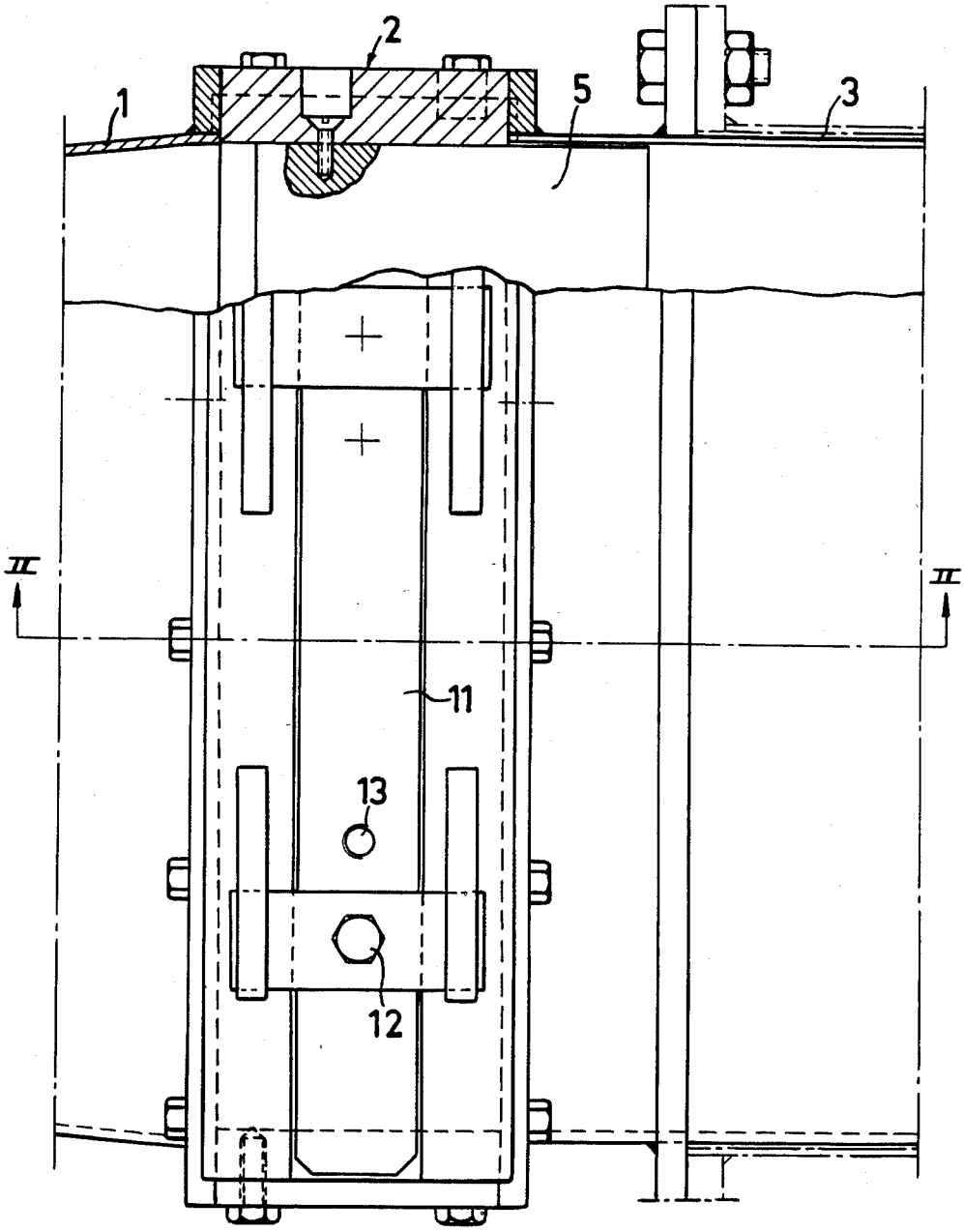
FIG. 1 is a top, elevational, partially sectional view of a mixing chamber in accordance with the present invention.

The particular mixing chamber illustrated in the drawings is intended to accomplish a mixture of air with a pulp suspension generally having a concentration of between about 1 and 2 percent.

The mixing chamber itself comprises an inlet portion 1, in the form of a passageway, the cross-section of which in the direction of flow of the suspension transforms successively from a circular configuration to an oblong, rectangular shape, i.e., by decreasing the height and increasing the width thereof. The inlet portion 1 leads to a mixing portion 2, which in turn leads to an outlet portion 3. The overall width of the passageway is maintained through the inlet, mixing and outlet portions 1, 2 and 3, respectively, while the height and cross-section of the passageway successively increases in the outlet portion 3. The upper and lower walls which define the outlet portion 3 diverge at a constant angle, suitably between about 5° and 10°, and preferably at about 7°.

Figure 2:
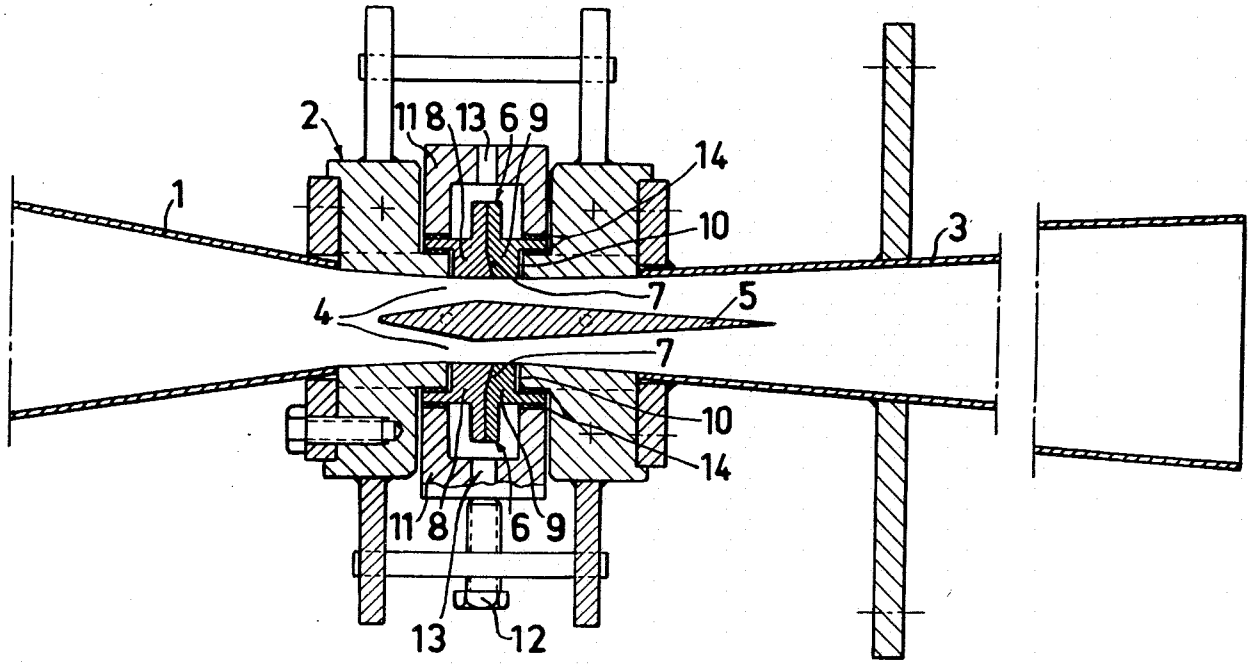
FIG. 2 is a side, elevational, sectional view of the mixing chamber shown in FIG. 1, taken along lines II—II thereof.

The mixing portion 2 of the device is divided into two parallel slit-shaped passages 4 by means of a wing member 5, which is immovably disposed centrally in the mixing portion 2, and which extends across the entire width of the passageway. The wing member 5 has an imperforate, continuous external surface and a thickness which first increases successively in the direction of flow (i.e., from the inlet to the outlet, or from left to right in FIG. 2) and which thereafter decreases successively, in a manner such that the thickest portion of the wing member 5 defines the narrowest portion of the passageway, and therefore also of the passages 4. These two passages 4 diverge from this narrowest portion substantially symmetrically in relation to the longitudinal direction of the passageway. The angle of such divergance is substantially the same as is the angle of the subsequent outlet portion, i.e., about 5° to 10°, and preferably about 7°.

Each passage 4 communicates with an air supply means 6, through a slit aperture 7 which extends in a transverse direction to the passageway across its entire width. The width of slit aperture 7 is adjustable, and the aperture itself is located substantially directly in front of the thickest portion of the wing member, which therefore corresponds to the narrowest portion of the passageways. Each passage has a height of from about 4 to 16 mm, and preferably from about 6 to 10 mm, in order to obtain an effective air admixture. The air slit should be from about 0.1 to 1.0 mm, and preferably from about 0.2 to 0.5 mm. The air slit is preferably directed obliquely in the direction of flow of the suspension.

Each of the air supply means 6 comprises two nozzle portions, 8 and 9, which define the air slit 7. The distance between the nozzle portions 8 and 9 is adjustable, such as by means of insert plates. The nozzle portions 8 and 9 are located, respectively, in a transverse recess 10 in the upper and lower defining walls of the mixing portion 2, and nozzle portions 8 and 9 are retained in place by means of a bar 11 and screws 12. In the bar 11 inlet apertures 13 for air are located. Seals 14 are located between the walls of the mixing portion 2 and the nozzle portions 8 and 9, and between the nozzle portions 8 and 9 and bar 11, respectively.

The length of the outlet portion 3 is intended to be adjusted with respect to the rate at which the suspension is intended to travel when it leaves the outlet portion and flows into a subsequent flotation container (not shown in the drawings). The concentration of the particular pulp suspension in question is also to be taken into consideration. Thus, suitable length for the outlet portion 3 should be such that the ratio of the areas as between the narrowest portion of the passageway and the end of the outlet portion should be between about 1:4 and 1:6. The object of employing the configuration of the outlet portion is to smooth the flow of the pulp suspension, since the admixture of air in the mixing portion 2 gives rise to substantial turbulence.

By designing a mixing device according to this invention, a fiber suspension having a very uniform distribution of air bubbles of a suitable size for subsequent flotation processes is obtained. The flow leaving the mixing device is also substantially free of turbulence, and a high flow rate can be obtained in order to promote the subsequent flotation process.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

We claim:

1. Apparatus for mixing gas bubbles into a fiber suspension containing impurities in order to remove said impurities by means of flotation, said apparatus comprising an inlet for said fiber suspension, an outlet for said fiber suspension including said gas bubbles therein, said outlet including diverging upper and lower wall portions, an intermediate mixing section between said inlet and said outlet, said intermediate mixing section including an upper wall surface, a lower wall surface, and a wing member immovably disposed between said upper and lower wall surfaces thereby creating upper and lower wall passages between said wing member and said upper and lower wall surfaces of said intermediate mixing section, said wing member including an imperforate, continuous external surface, a diverging portion facing said inlet, a converging portion facing said outlet, and a central portion having a maximum thickness therebetween, whereby said upper and lower passages have a minimum transverse dimension at a location corresponding to the central portion of said wing member, said converging portion of said wing member corresponding with said diverging upper and lower wall portions of said outlet, whereby said upper and lower passages diverge substantially symmetrically in the direction of flow of said fiber suspension containing said gas bubbles therein, gas injection means including a transversely extending slot in both said upper and lower wall surfaces of said intermediate mixing section at locations corresponding to said central portion of said wing member, said gas injection means comprising adjustable gas injection means, including upper and lower pairs of axially movable nozzle portions adjustably carried in corresponding recesses formed in said upper and lower wall surfaces of said mixing section, for adjusting the dimensions of said transversely extending slot, and gas supply means communicating with said gas injection means for supplying said gas to said fiber suspension flowing through said upper and lower passages of said intermediate mixing section.

2. The apparatus of claim 1, wherein said inlet has an elongated rectangular cross-sectional configuration.

3. The apparatus of claim 1, wherein said wing member is centrally located between said upper and lower wall portions of said intermediate mixing section.

4. The apparatus of claim 1, wherein said diverging upper and lower wall surfaces of said outlet diverge at a first predetermined angle, and wherein said converging portion of said wing member converges at a second predetermined angle, and wherein said first and second predetermined angles are substantially the same.

5. The apparatus of claim 4, wherein said first and second predetermined angles are between about 5° and 10°.

6. The apparatus of claim 1, wherein said minimum transverse dimensions of said upper and lower passages are between about 4 and 16 mm.

7. The apparatus of claim 6, wherein said minimum transverse dimensions are between about 6 and 10 mm.

8. The appara1tus of claim 1, wherein the ratio of the cross-sectional area of said intermediate mixing section at a location corresponding to said central portion of said wing member to the area of said outlet is between about 1:4 and 1:6.

9. The apparatus of claim 1, wherein said transversely extending slots in said upper and lower wall surfaces of said intermediate mixing section are directed obliquely towards the direction of flow of said fiber suspension from said inlet to said outlet.

10. The apparatus of claim 1 wherein said converging portion of said wing member extends into said outlet a substantial portion of a length of said outlet.

* * * * *